US009410391B2

(12) United States Patent
Guven et al.

(10) Patent No.: US 9,410,391 B2
(45) Date of Patent: Aug. 9, 2016

(54) VALVE SYSTEM

(71) Applicant: Schlumberger Technology Corporation, Sugar Land, TX (US)

(72) Inventors: Oguzhan Guven, Bellaire, TX (US); Gary L. Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 355 days.

(21) Appl. No.: 13/660,018

(22) Filed: Oct. 25, 2012

(65) Prior Publication Data

US 2014/0116717 A1 May 1, 2014

(51) Int. Cl.

| | |
|---|---|
| ***E21B 29/12*** | (2006.01) |
| ***E21B 7/12*** | (2006.01) |
| ***E21B 34/06*** | (2006.01) |
| ***E21B 34/08*** | (2006.01) |
| ***E21B 29/04*** | (2006.01) |
| ***E21B 29/08*** | (2006.01) |
| ***E21B 34/04*** | (2006.01) |

(52) U.S. Cl.
CPC ..... *E21B 29/04* (2013.01); *E21B 29/08* (2013.01); *E21B 34/045* (2013.01)

(58) Field of Classification Search
USPC ..... 166/332.3; 251/304, 315.01
See application file for complete search history.

(56) References Cited

U.S. PATENT DOCUMENTS 3,270,772 A * 9/1966 Rakus ..... F16K 5/0615 137/246
3,926,252 A 12/1975 Ribeyre
4,137,935 A * 2/1979 Snowdon ..... B65G 53/4658 137/242
4,160,478 A 7/1979 Calhoun et al.
4,215,749 A 8/1980 Dare et al.
4,287,954 A * 9/1981 Krause ..... E21B 34/105 166/322
4,878,651 A 11/1989 Meyer
5,284,209 A 2/1994 Godfrey
5,551,665 A * 9/1996 Noack ..... E21B 29/04 166/324
5,771,974 A 6/1998 Stewart et al.
6,152,229 A * 11/2000 Jennings ..... E21B 29/04 137/613
6,231,265 B1 5/2001 Rytlewski et al.
6,250,383 B1 6/2001 Patel
6,260,822 B1 7/2001 Puranik (Continued)

FOREIGN PATENT DOCUMENTS

WO 2014/011639 A1 1/2014

OTHER PUBLICATIONS

International Search Report and Written Opinion for corresponding International App No. PCT/US2013/062824, 14 pgs.

*Primary Examiner* — Matthew R Buck
*Assistant Examiner* — Douglas S Wood
(74) *Attorney, Agent, or Firm* — Tuesday Kaasch

(57) ABSTRACT

A system and methodology facilitates utilization of a valve of a type which may be used as a subsea test tree. The valve comprises a valve element pivotably mounted in a housing having a passageway therethrough. The valve element may be actuated between an open position and a closed position blocking the passageway. A cutter is disposed along a first surface of the valve element and a seal system is positioned for engagement with a second surface of the valve element to provide separate cutting and sealing surfaces. Actuating the valve element from the open position to the closed position enables cutting of a conveyance, that may be positioned through the passageway, while simultaneously forming a seal along a separate surface to sealingly block the passageway.

22 Claims, 7 Drawing Sheets

(56) References Cited

U.S. PATENT DOCUMENTS

| | | | | |
|---|---|---|---|---|
| 6,401,826 | B2 | 6/2002 | Patel | |
| 6,575,426 | B2 | 6/2003 | Sundararajan | |
| 6,601,650 | B2 | 8/2003 | Sundararajan | |
| 6,684,897 | B2 | 2/2004 | Sundararajan | |
| 6,966,537 | B2 | 11/2005 | Sundararajan | |
| 7,086,467 | B2 | 8/2006 | Schlegelmilch et al. | |
| 7,578,349 | B2 | 8/2009 | Sundararajan et al. | |
| 7,661,367 | B2 | 2/2010 | Yang et al. | |
| 8,308,132 | B2 | 11/2012 | Partridge | |
| 8,336,630 | B2 | 12/2012 | Kerr | |
| 8,662,183 | B1 * | 3/2014 | Vickio, Jr. | E21B 29/08 166/361 |
| 2005/0252660 | A1 * | 11/2005 | Hughes | E21B 34/12 166/334.2 |
| 2009/0229829 | A1 | 9/2009 | Lloyd et al. | |
| 2009/0272539 | A1 | 11/2009 | Lloyd et al. | |
| 2010/0308247 | A1 | 12/2010 | Partridge | |

* cited by examiner

VALVE SYSTEM

BACKGROUND

Hydrocarbon fluids such as oil and natural gas may be obtained from subsea wells. Subsea test trees enable well testing and well cleanup operations to be conducted on subsea wells from an offshore floating rig. In the event the well is to be shut down, the subsea test tree includes valves for shutting in the well and for preventing discharge of the landing string contents into an associated riser. The subsea test tree also comprises a latch mechanism for safely disconnecting the landing string.

SUMMARY

In general, the present disclosure provides a system and method of utilizing a valve having a configuration which may be used in a subsea test tree. The valve comprises a valve element pivotably mounted in a housing having a passageway therethrough. The valve element may be actuated between an open position and a closed position blocking the passageway. A cutter is disposed along a first surface of the valve element and a seal system is positioned for engagement with a second surface of the valve element to provide separate cutting and sealing surfaces. Actuating the valve element from the open position to the closed position enables cutting of a conveyance, that may be positioned through the passageway, while simultaneously forming a seal along a separate surface to sealingly block the passageway.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally involves a system and methodology in which a valve is used to perform both a cutting and sealing function upon closure. Such a valve may be used as a safety valve or other type of valve in a variety of subsea well applications and other well related applications. The technique utilizes a valve having a valve element pivotably mounted in a housing with a passageway therethrough. By way of example, the passageway may be designed to accommodate passage of a conveyance, e.g. coil tubing, wireline, or slickline, and/or to accommodate fluid flow.

The valve element may be actuated between an open position and a closed position blocking the passageway. A cutter is disposed along a first surface of the valve element and a seal system is positioned for engagement with a second surface of the valve element to provide cutting and sealing functions which are separated from each other. Actuating the valve element from the open position to the closed position enables cutting of a conveyance (that may be positioned through the passageway) while simultaneously forming a seal along a separate surface to sealingly block the passageway.

In certain applications, the valve may be designed as a shear/seal rotary curved gate valve which may be used to reliably and repeatedly cut a conveyance and to provide a gas tight seal after cutting of the conveyance. The cutting and sealing functions may be performed along separated surfaces to separate the functionality and to preserve the sealing surface even if the cutter/cutting surface is marred by the cutting operation. When employed in subsea test trees, the valve may be used to provide a fast acting and reliable mechanism for shutting in the well while preventing discharge of landing string contents into the riser and for disconnecting the landing string from the test ring. In some applications, the valve is designed to provide compact radial packaging while utilizing separate cutting and sealing surfaces.

Figure 1:
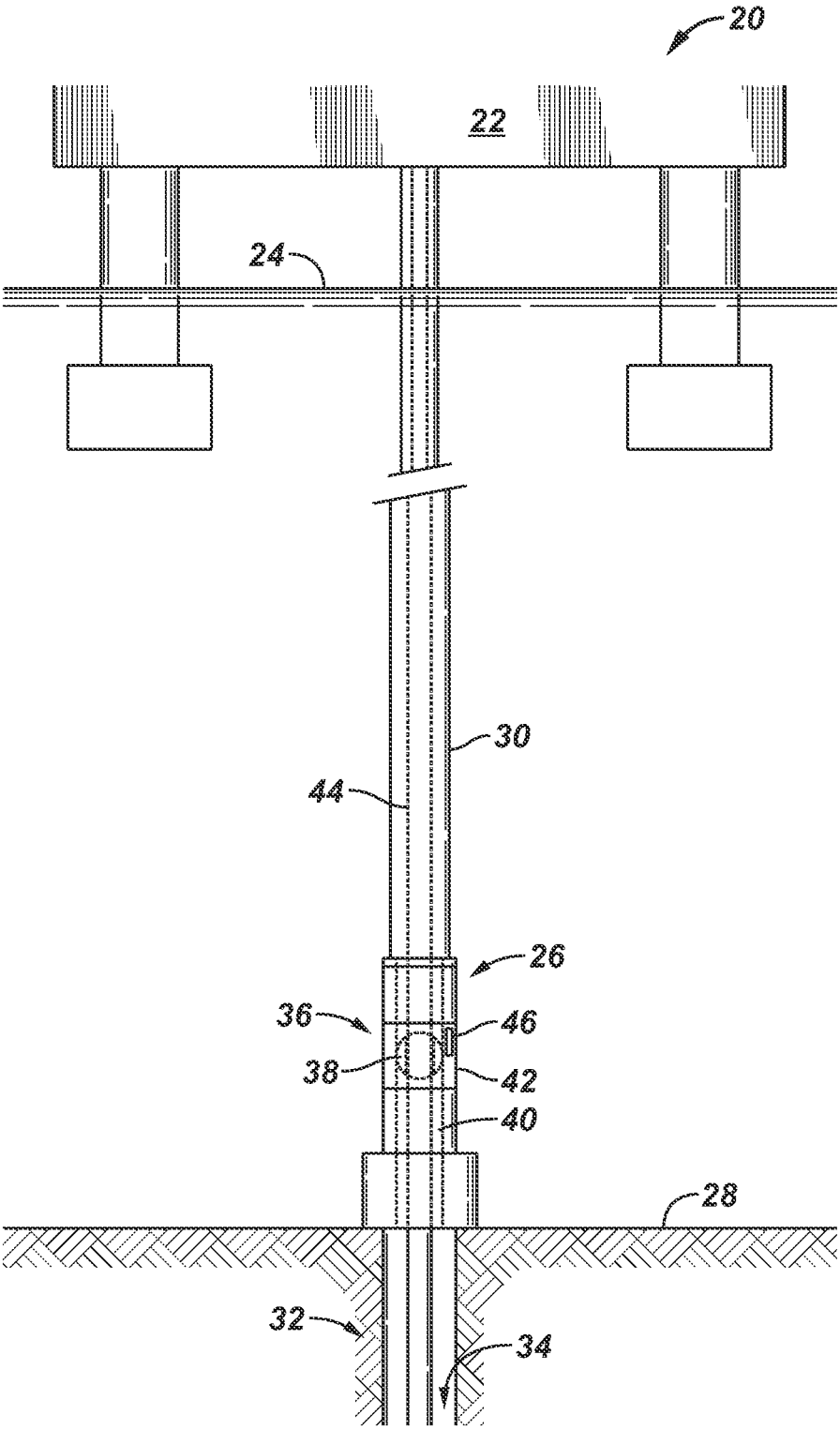
FIG. 1 is a schematic illustration of a subsea well system having a subsea test tree with a valve for sealing off a flow-through passageway through the subsea test tree, according to an embodiment of the disclosure.

Referring generally to FIG. 1, an embodiment of a system, e.g. a subsea well system, is illustrated as comprising a valve designed to shear a conveyance and to seal off a passageway. By way of example, the valve may be employed in subsea test trees and in other subsea or surface well equipment. The valve is useful in many types of operations, including service operations and production operations. Additionally, the valve may be designed to accommodate passage of many types of conveyances, including coil tubing conveyances, wireline conveyances, slickline conveyances, and other suitable conveyances. It should further be noted the valve may be used in combination with other types of equipment in both well and non-well related applications.

In the example of FIG. 1, a subsea well system 20 is illustrated as comprising a surface structure 22, e.g. a floating rig, positioned at the sea surface 24. The surface structure 22 may be coupled with a subsea test tree 26, located at a seafloor 28, by a riser 30. The subsea test tree 26 is disposed above a well 32 which may comprise at least one wellbore 34. In the example illustrated, a valve 36 is mounted in the subsea test tree 26 and comprises a pivotable valve element 38 which may be actuated to an open position allowing access through a subsea test tree passageway 40 or to a closed position blocking access through passageway 40. The valve element 38 may be pivotably mounted to a supporting housing 42 which surrounds the valve element 38 and may be part of the subsea test tree 26. In some applications, the valve 36 is a modular valve and housing 42, as part of that modular valve 36, is designed for connection into the subsea test tree 26 or into other suitable equipment.

Depending on the subsea application, a conveyance 44 may be used to convey tools and/or other equipment down through riser 30 and subsea test tree 26. The passageway 40 is sized to accommodate passage of the tools, equipment and conveyance 44 down into wellbore 34. Upon the occurrence of certain events, the passageway 40 may be rapidly closed to shut in the well 32 by actuating valve 36 and shifting the valve element 38 to a closed, sealed position. The valve element 38 is designed to cut through the conveyance 44 to enable the rapid closure and a sealing off of passageway 40. Depending on the design of valve 36 and on the environment in which it is employed, a variety of actuators 46 may be used to actuate valve element 30 between open and closed positions. By way of example, actuators 46 may comprise hydraulic actuators, e.g. hydraulic pistons, electrical actuators, e.g. solenoids, electromechanical actuators, or other suitable actuators designed to rotate the valve element 38 between open and closed positions.

Figure 2:
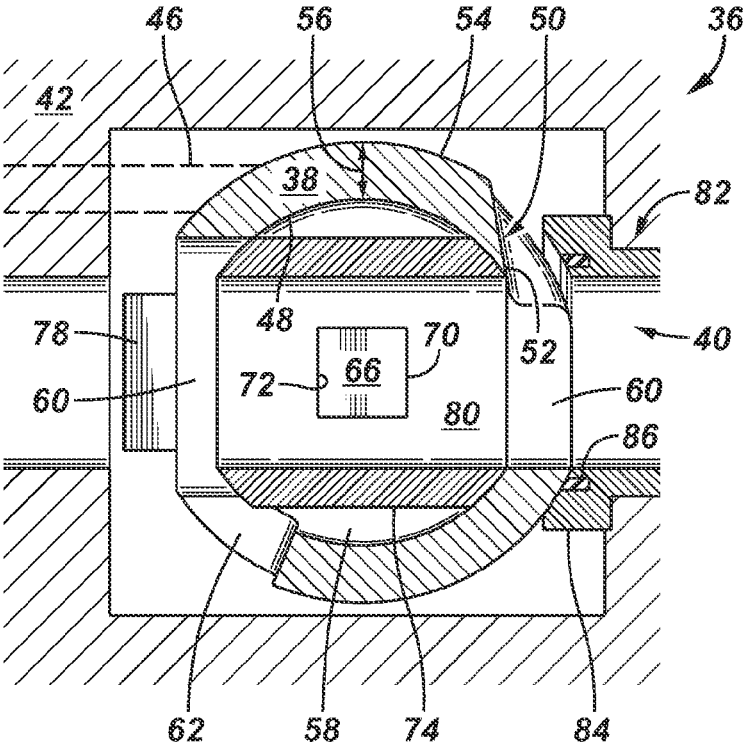
FIG. 2 is a cross-sectional view of an example of the valve illustrated in FIG. 1, according to an embodiment of the disclosure.
Figure 3:
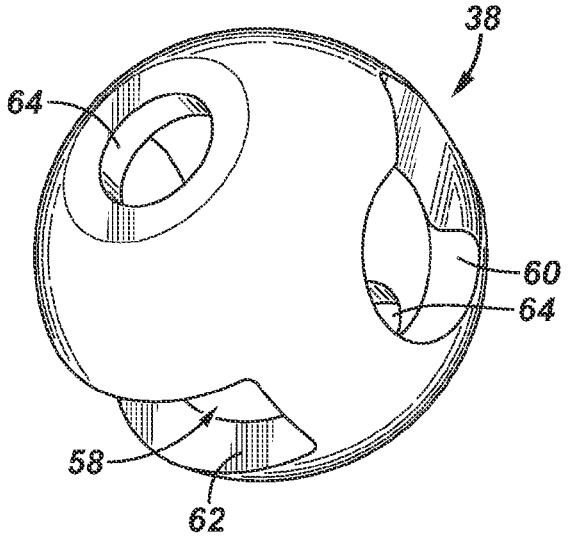
FIG. 3 is an orthogonal view of an example of a valve element that may be used in the valve illustrated in FIG. 2, according to an embodiment of the disclosure.

Referring generally to FIG. 2, an embodiment of valve 36 is illustrated. In this embodiment, valve element 38 is arcuate in shape and has a first surface, e.g. a first arcuate surface, separated from a second surface, e.g. a second arcuate surface, in a manner that separates cutting and sealing functions. By way of example, the first surface may comprise an interior surface 48 to which a cutter 50 is mounted. Cutter 50 may be formed with a cutting edge 52 attached to or integrally formed from the material used to construct valve element 38. In this example, the second surface comprises an exterior surface 54 which forms a sealing surface. The interior surface 48 and the exterior surface 54 are separated from each other by a material thickness 56 to separate the cutting and sealing functions. It should be noted, the first and second surfaces may be reversed in some embodiments so that cutter 50 is positioned along the exterior surface.

With additional reference to FIGS. 3-6, examples of components that may be used to construct valve 36 are illustrated individually to facilitate explanation. For example, valve element 38 may be in the form of a curved gate valve having a full or partial ball valve element with a hollow interior 58 and openings 60. Opening 60 are aligned with and form part of passageway 40 when valve 36 is in the open position illustrated in FIG. 2. The cutter 50 may be positioned adjacent one of the openings 60 and a relief 62 may extend from the other of the openings 60 to accommodate and receive the conveyance 44 when the valve 36 is transitioned to a closed position. In this embodiment, the ball style valve element 38 further comprises pivot openings 64 which allow the valve element 38 to rotate/pivot about pivot pins 66.

Figure 4:
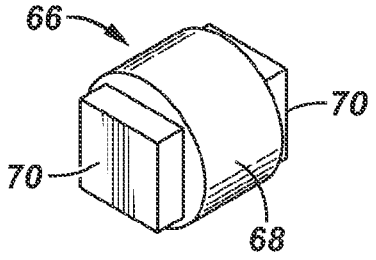
FIG. 4 is an orthogonal view of an example of a pin member used to mount a cutting insert of the valve to a supporting housing, according to an embodiment of the disclosure.
Figure 5:
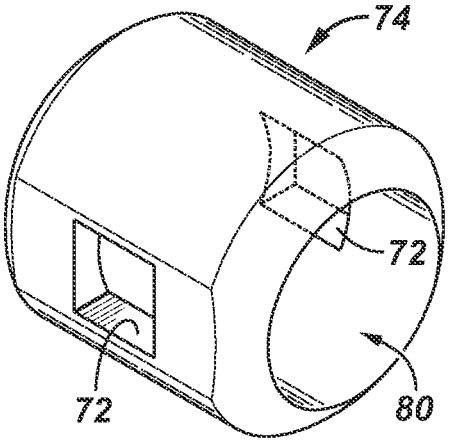
FIG. 5 is an orthogonal view of an example of a cutting insert against which a conveyance may be cut during closure of the valve element, according to an embodiment of the disclosure.
Figure 6:
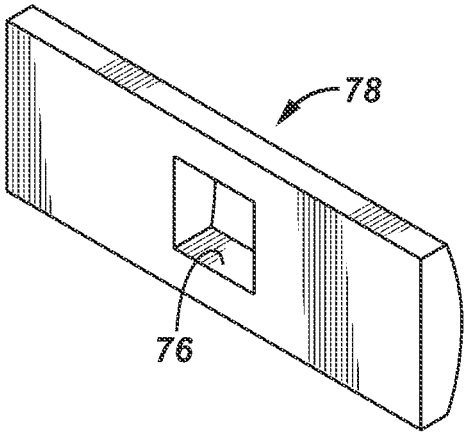
FIG. 6 is an orthogonal view of an example of an anchor block by which the pin illustrated in FIG. 4 may be mounted to the supporting housing, according to an embodiment of the disclosure.

Each pivot pin 66 may be designed with a generally cylindrical center region 68 sized for receipt in a corresponding pivot opening 64. As best illustrated in FIG. 4, the pivot pin 66 also may comprise profiled regions 70 located at opposing longitudinal ends of the cylindrical center region 68. The profiled regions 70 are designed to engage a corresponding opening 72 formed in a cutting insert 74 (see FIG. 5) and a corresponding opening 76 formed in housing 42. By way of example, the corresponding opening 76 may be formed in an anchor block 78 (see FIG. 6) forming part of housing 42, e.g anchor block 78 may be held in a corresponding slot of housing 42. By way of example, profiled regions 70 and corresponding openings 72, 76 may be rectangular in shape (or of another suitable shape) to prevent relative rotation between the cutting insert 74 and the housing 42/anchor block 78 when the valve 36 is assembled as illustrated in FIG. 2.

When valve 36 is assembled as illustrated in FIG. 2, the cutting insert 74 is located in the hollow interior 58 of valve element 38. The cutting insert 74 comprises a hollow interior 80 which aligns with openings 60 when valve 36 is in the illustrated open position. This allows movement of conveyance 44 and/or fluids through valve 36 and along the passageway 40 extending through valve 36. The cutting insert 74 is prevented from rotating with respect to housing 42/anchor block 78 via engagement of profiled regions 70 with the corresponding openings 72, 76. However, valve element 38 may be freely rotated/pivoted via actuator 46 about the cylindrical center regions 68 of pivot pins 66. The cutting insert 74 supports the conveyance 44 during cutting and provides an edge for cutter 50 to act against when severing conveyance 44 during a valve closure.

As further illustrated in FIG. 2, the valve 36 comprises a seal system 82 which may comprise a seal retainer 84 for carrying a seal or seals 86. The seal retainer 84 is designed to position seal 86 against the exterior seal surface 54 when valve 36 is transitioned to a closed position. Thus, the cutting function is performed along the interior surface 48 and the sealing function is performed along the exterior surface 54 separated from interior surface 48 by thickness 56. In subsea well applications, the seal retainer 84 and seal 86 may be used to ensure a gas tight barrier/seal in the wellbore before disconnecting the landing string from the test string.

Figure 7:
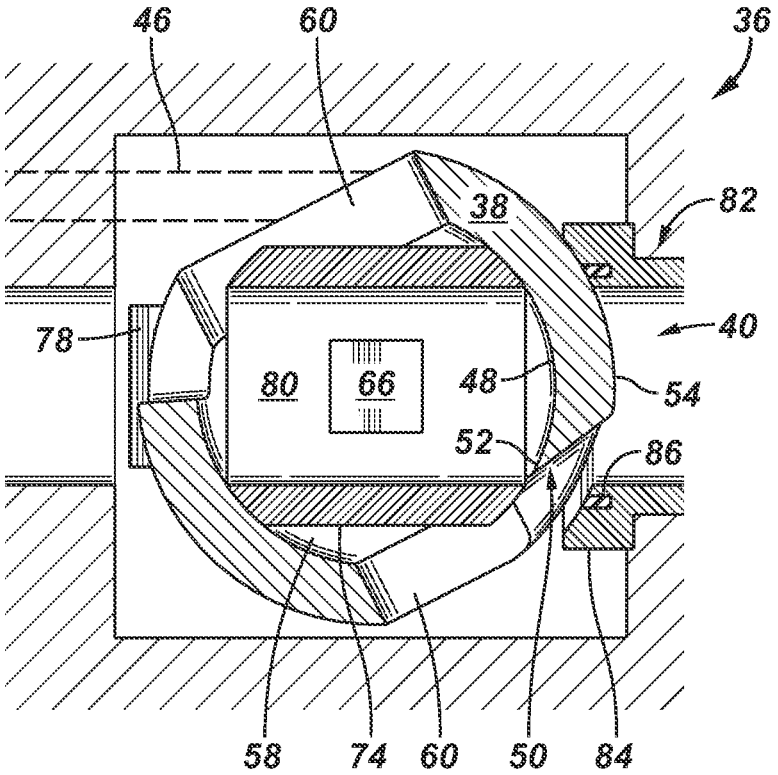
FIG. 7 is a cross-sectional view of the valve illustrated in FIG. 2 but in a different operational configuration, according to an embodiment of the disclosure.
Figure 8:
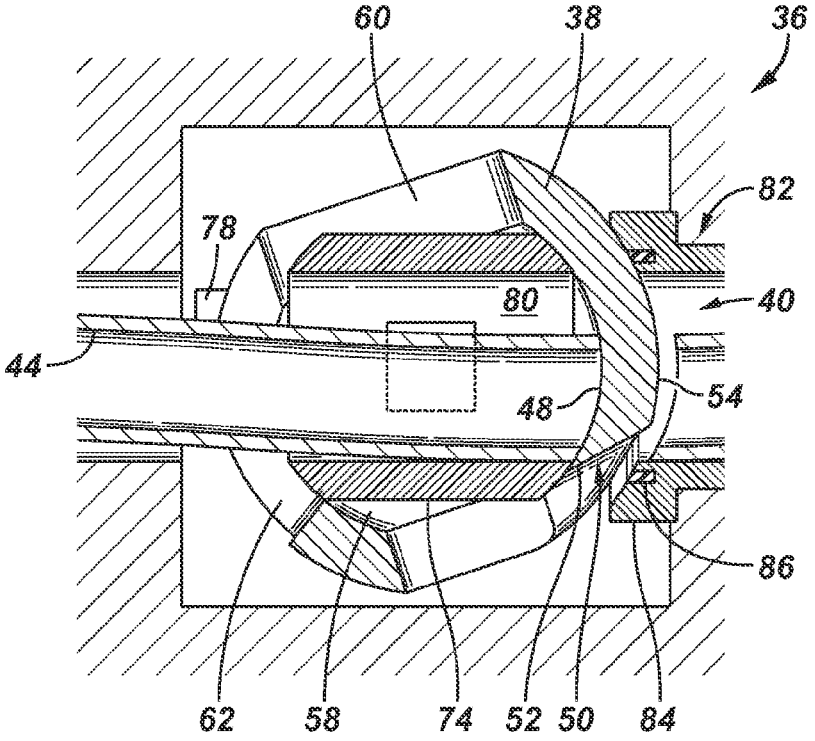
FIG. 8 is a cross-sectional view of the valve illustrated in FIG. 2 but in a different operational configuration, according to an embodiment of the disclosure.
Figure 9:
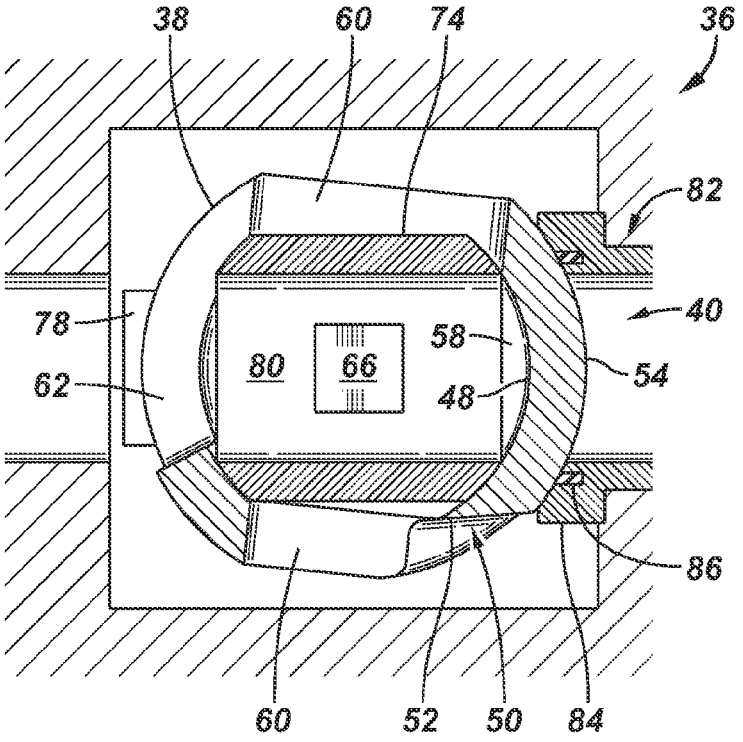
FIG. 9 is a cross-sectional view of the valve illustrated in FIG. 2 but in a different operational configuration, according to an embodiment of the disclosure.

Referring generally to FIGS. 7-9, a cutting operation is illustrated in which the valve 36 is transitioned from an open position (see FIG. 2) to a closed position (see FIG. 9). When an event occurs which makes it desirable to transition valve 36 to a closed position, an appropriate signal is provided to actuator 46 which may comprise a translatable piston or other actuating device pivotably coupled to valve element 38. The actuator 46 causes valve element 38 to pivot/rotate about pins 66 such that cutting edge 52 transitions across passageway 40, as illustrated in FIG. 7. If a conveyance 44, e.g. coil tubing, is positioned through valve 36 along passageway 40, the pivoting movement of valve member 38 causes cutting edge 52 to cut/shear the conveyance against the corresponding edge of cutting insert 74, as best illustrated in FIG. 8. However, the relief 62 located on the opposite side of valve element 38 from cutter 50 reduces the potential for double cutting the conveyance.

Continued transition of valve element 38 to the closed position illustrated in FIG. 9 causes seal 86 to fully engage exterior sealing surface 54. Because the cutting is performed at the separated, interior surface 48, the exterior sealing surface 54 is not marred or abraded during the cutting process so as to provide a secure, repeatable, gas tight seal. After cutting the conveyance 44, the severed portions of the conveyance 44 may be dropped or removed from the subsea test tree 26 or other equipment containing valve 36.

Figure 10:
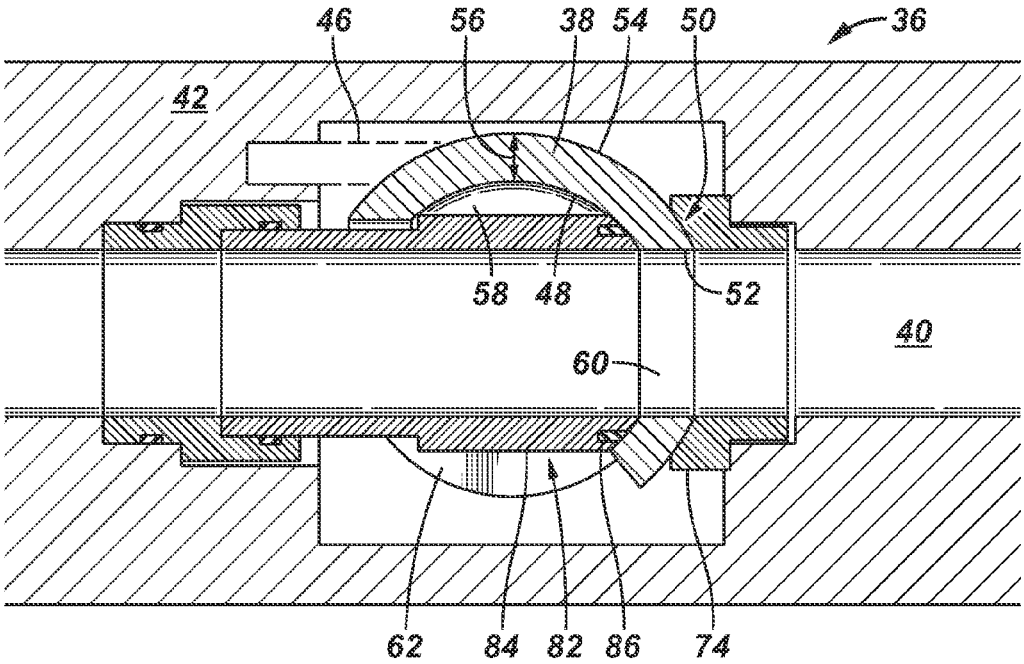
FIG. 10 is a cross-sectional view of another example of the valve, according to an embodiment of the disclosure.
Figure 11:
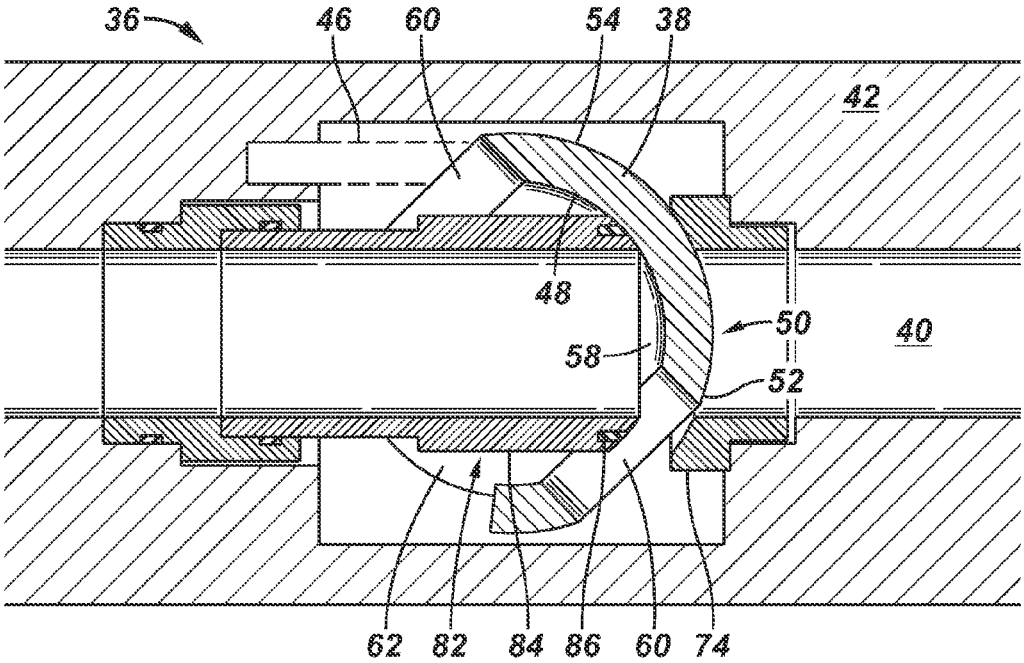
FIG. 11 is a cross-sectional view of the valve illustrated in FIG. 10 but in a different operational configuration, according to an embodiment of the disclosure.
Figure 12:
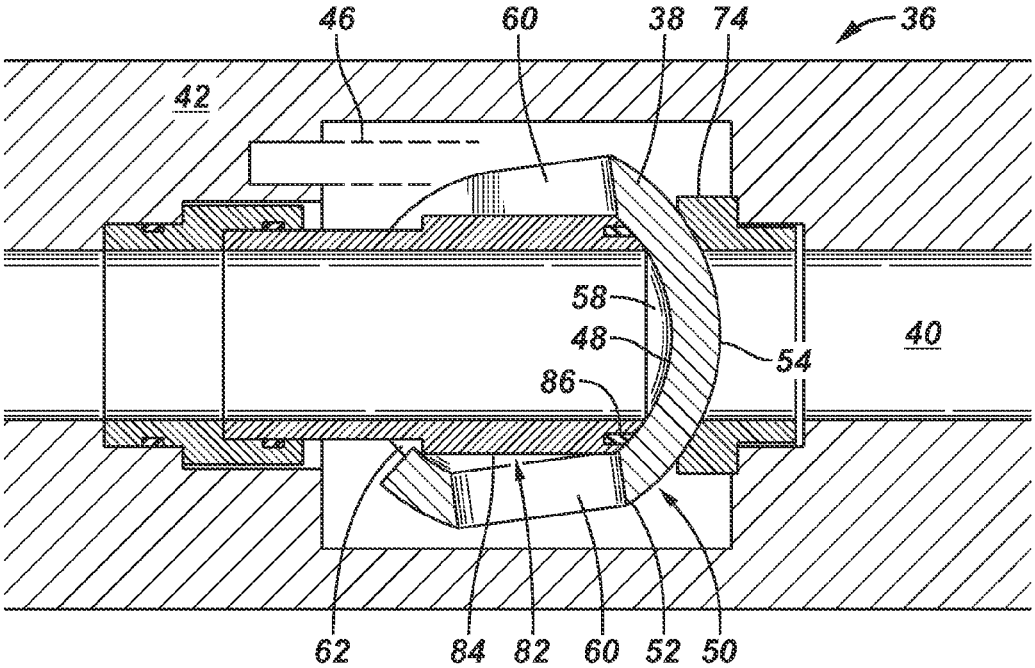
FIG. 12 is a cross-sectional view of the valve illustrated in FIG. 10 but in a different operational configuration, according to an embodiment of the disclosure.

Referring generally to FIGS. 10-12, another embodiment of valve 36 is illustrated. In this embodiment, valve element 38 again has arcuate inner and outer surfaces 48, 54, however the cutter 50 and cutting edge 52 have been located along the exterior surface 54. Additionally, the inner surface 48 serves as an arcuate sealing surface to provide the gas tight seal upon closure of valve 36. Thus, the cutting function and the sealing function are again separated and occur on opposed surfaces separated by material thickness 56.

Consequently, the cutting insert 74 is located outside of valve element 38 for cooperation with the external cutting edge 52 of cutter 50. In this example, the seal system 82 is located in hollow interior 58 of valve element 38. The seal system 82 is designed so that seal retainer 84 positions the seal or seals 86 against interior surface 48 when valve 36 is transitioned to a closed position.

Similar to the embodiment illustrated in FIG. 2, when an event occurs which makes it desirable to transition valve 36 to a closed position, an appropriate signal is provided to actuator 46 which causes valve element 38 to pivot/rotate about pins 66 such that cutting edge 52 (the external edge in this embodiment) transitions across passageway 40, as illustrated in FIG. 11. If a conveyance 44, e.g. coil tubing, is positioned through valve 36 along passageway 40, the pivoting movement of valve member 38 causes the outer cutting edge 52 to cut/shear the conveyance 44 against the corresponding edge of external cutting insert 74. Relief 62 reduces the potential for double cutting the conveyance.

Continued transition of valve element 38 to the closed position illustrated in FIG. 12 causes seal 86 to fully engage the interior sealing surface 48. Because the cutting is performed at the separated, exterior surface 54, the interior sealing surface 48 is not marred or abraded during the cutting process so as to provide a secure, repeatable, gas tight seal. As with the previously described embodiment, the valve element 38 may be in the form of a full or partial ball element pivotably mounted on pivot pins 66. In this embodiment, the pivot pins 66 may be positioned to extend between seal system 82 and housing 42, e.g. anchor block 78.

Figure 13:
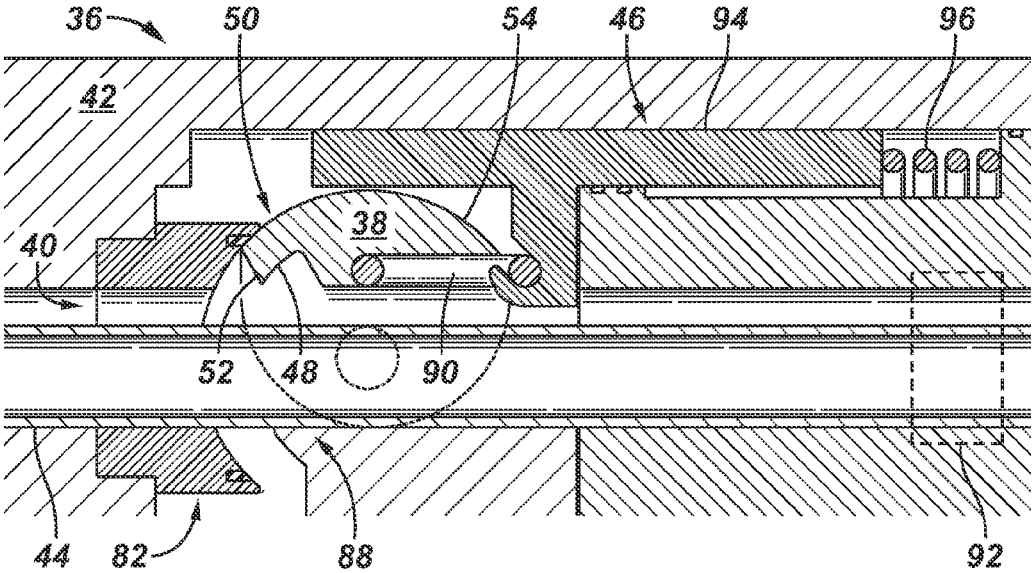
FIG. 13 is a cross-sectional view of another example of the valve, according to an embodiment of the disclosure.
Figure 14:
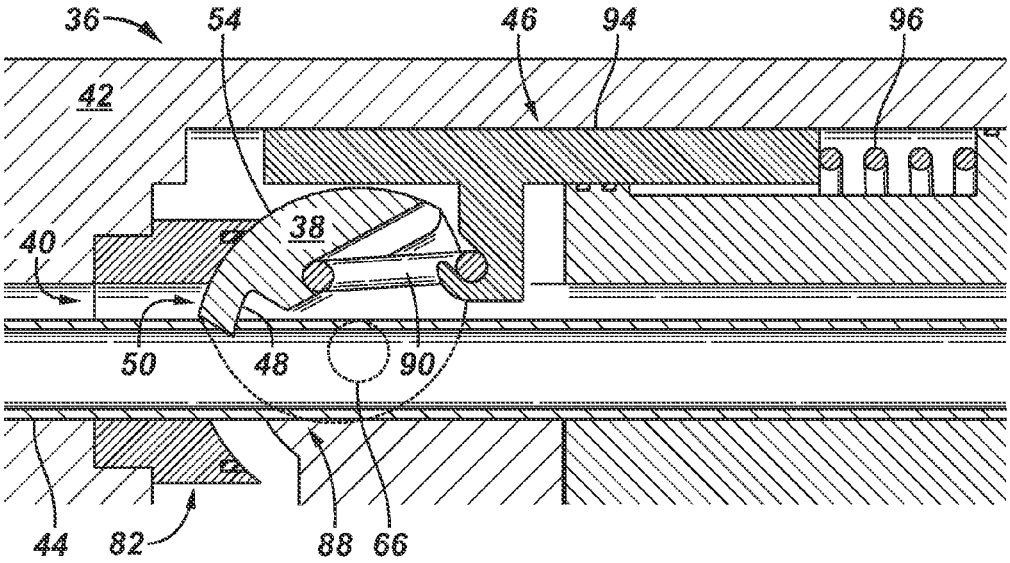
FIG. 14 is a cross-sectional view of the valve illustrated in FIG. 13 but in a different operational configuration, according to an embodiment of the disclosure.
Figure 15:
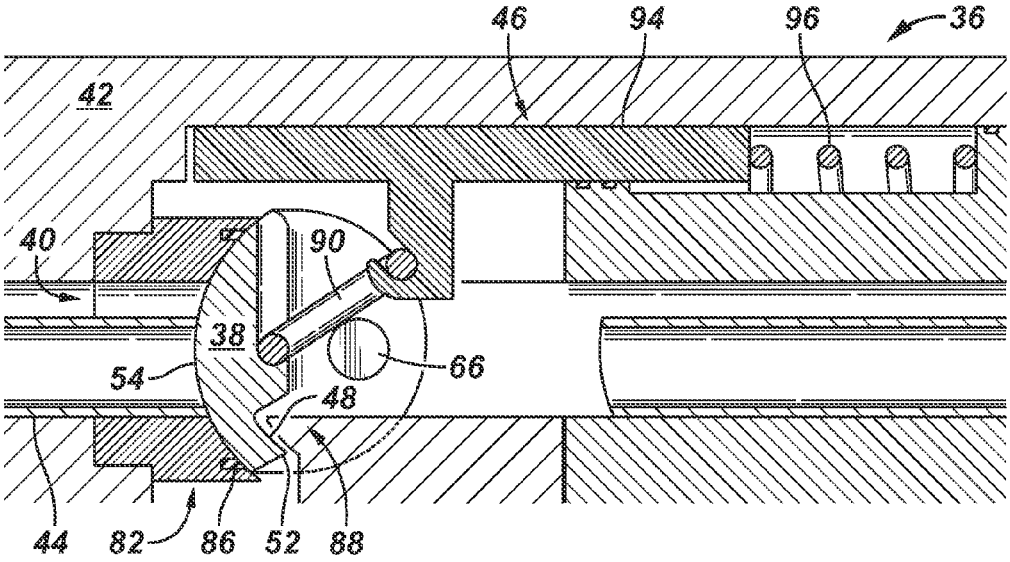
FIG. 15 is a cross-sectional view of the valve illustrated in FIG. 13 but in a different operational configuration, according to an embodiment of the disclosure.

Referring generally to FIGS. 13-15, another embodiment of valve 36 is illustrated. In this embodiment, valve element 38 again has arcuate inner and outer surfaces 48, 54, however the valve element 38 is formed as a partial ball, e.g. a half ball, which cuts along the interior surface 48 and seals along the exterior surface 54. Again, because the cutting surfaces can become scarred due to cutting, the separation of the seal surface, e.g. arcuate surface 54, from the cutting surface enables secure, gas tight seals even if the valve 36 undergoes repeated actuations.

In this embodiment, the space normally occupied by the omitted part of the ball 38 can be used to create a rigid cutting support 88 which, in combination with the cutting edge 52 located on the inside diameter of valve element 38 provides a mechanically efficient mechanism for cutting. In this example, the valve element 38 is actuated, e.g. pivoted, by an articulating actuator arm 90 which is positioned to apply force more in the direction of cutting. This directionally controlled force also creates greater efficiency with respect to cutting and enables use of a lower powered actuator 46. By way of example, actuator 46 may comprise a hydraulic controller 92 connected to a piston member 94. The piston member 94 is slidably mounted in housing 42 and coupled to articulating actuator arm 90 to move the actuator arm 90, and thus the valve element 38, upon hydraulic input from hydraulic controller 92. In some applications, a spring member 96 may be used in cooperation with piston member 94 to bias valve member 38 toward a desired position, such as the open position illustrated in FIG. 13. It should be noted, however, that other types of actuators 46 may be employed as discussed above.

If valve 36 is to be transitioned to a closed position, an appropriate signal is provided to actuator 46, e.g. to hydraulic controller 92, to shift piston member 94 and to thus actuate articulated actuating arm 90. As illustrated in FIG. 14, articulated actuating arm 90 pivots valve element 38 about pivot pin 66 and drives cutting edge 52 into conveyance 44. Continued rotation of valve member 38 severs the conveyance 44 and places the external, sealing surface 54 into sealing engagement with seal 86 of seal system 82. The separation of cutting and sealing functions combined with the efficiency of the cutting action enable rapid shut-in and disconnect operations which can be repeated.

The valve 36 may have a variety of configurations for use in subsea applications and other applications. Additionally, the components and materials used in constructing the valve may vary from one application to another depending on operational and environmental parameters. The cutting and sealing functions may be on opposed inner or outer surfaces or on other separated surfaces depending on the design and arrangement of valve components. Similarly, the valve actuation mechanisms may rely on hydraulic systems powered via control lines, wellbore pressures, pressure storage devices, or other suitable pressure sources. The valve actuation mechanisms also may utilize electrical actuators, electromechanical actuators, combinations of actuators, and other suitable mechanisms for achieving the desired valve actuation. Cutters and cutting edges also may be designed from a variety of components and/or materials which may be selected based on the environment and/or materials to be cut.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea test tree, comprising:

a subsea test tree housing having a passageway sized to receive a conveyance therethrough; and a valve mounted along the passageway, the valve having:

a valve element pivotably mounted in the subsea test tree for movement between an open position in which the conveyance can pass through the passageway and a closed position;

a seal retainer positioning a seal to seal against a first radial surface of the valve element when the valve element is in the closed position; and a cutter positioned along a second radial surface of the valve element that is radially-offset from the first radial surface such that pivoting of the valve element to the closed position causes the cutter to cut through the conveyance if positioned in the passageway.

2. The system as recited in claim 1, wherein the cutter comprises a cutting edge formed on the valve element.

3. The system as recited in claim 1, wherein the first radial surface is a partially-spherical, radially outward surface of the valve element.

4. The system as recited in claim 1, wherein the first radial surface is a partially-spherical, radially inward surface of the valve element.

5. The system as recited in claim 1, wherein the valve further comprises a cutting insert located within the valve element to support the conveyance during cutting.

6. The system as recited in claim 5, wherein the cutting insert is generally tubular with an interior size to receive the conveyance, the cutting insert being directly connected to the subsea test housing by a pin having a circular surface about which the valve element pivots during cutting.

7. The system as recited in claim 1, wherein the valve element comprises a relief to receive the conveyance during pivoting of the valve element to the closed position.

8. The system as recited in claim 1, wherein the valve element is a ball valve element rotatably mounted about a cutting insert with the cutter located along an interior of the ball valve element.

9. The system as recited in claim 1, wherein the valve element is a ball valve element rotatably mounted adjacent a cutting insert with the cutter located along an exterior of the ball valve element.

10. The system as recited in claim 1, wherein the valve element is rotated by an articulating actuator arm.

11. The system as recited in claim 5, wherein the cutting insert defines a recess, and wherein a pin extends through the valve element and at least partially into the recess.

12. The system as recited in claim 5, wherein the cutting insert is completely located within the valve element.

13. A method of shutting in a well, comprising:

positioning a valve along a flow path through a subsea test tree;

providing the valve with a valve member pivotable between open and closed positions with respect to the flow path;

locating a cutter along a first radial surface of the valve member to enable cutting of a conveyance positioned in the flow path when the valve member is pivoted from the open position to the closed position; and arranging a seal to seal off the flow path by sealingly engaging the valve member along a second radial surface of the valve member, radially-offset from the first radial surface, when the valve member is pivoted to the closed position.

14. The method as recited in claim 13, wherein providing comprises providing the valve member in the form of a ball valve member.

15. The method as recited in claim 13, wherein providing comprises providing the valve member in the form of a partial ball valve member.

16. The method as recited in claim 13, further comprising cutting a coiled tubing conveyance by pivoting the valve member to the closed position.

17. The method as recited in claim 13, further comprising cutting a wireline conveyance by pivoting the valve member to the closed position.

18. The method as recited in claim 13, wherein locating the cutter along the first radial surface comprises locating a cutter edge along an exterior arcuate surface.

19. The method as recited in claim 13, wherein locating the cutter along the first radial surface comprises locating a cutter edge along an interior arcuate surface.

20. A valve, comprising:

a ball valve element rotatably mounted in a housing, the ball valve element having an exterior radial surface, an interior radial surface, and a passageway sized to receive a conveyance therethrough;

a cutter; and a seal system, the cutter and the seal system being radially-offset from one another along the exterior radial surface and the interior radial surface in a manner which separates the cutting and sealing functions.

21. The system as recited in claim 20, wherein the cutter is located along the exterior radial surface and the seal system is located along the interior radial surface.

22. The system as recited in claim 20, wherein the cutter is located along the interior radial surface and the seal system is located along the exterior radial surface.

* * * * *